US008959821B1

(12) United States Patent
Calvert

(10) Patent No.: US 8,959,821 B1
(45) Date of Patent: Feb. 24, 2015

(54) FIREARM BARREL-MODIFICATION SYSTEM

(71) Applicant: FBMS Associates, Trustee for Firearm Barrel-Modification System CRT Trust, Manassas, VA (US)

(72) Inventor: S. Mill Calvert, Manassas, VA (US)

(73) Assignee: FBMS Associates, Trustee for Firearm Barrel-Modification System CRT Trust, Manassas, VA (US)

( * ) Notice: Subject to any disclaimer, the term of this patent is extended or adjusted under 35 U.S.C. 154(b) by 0 days.

(21) Appl. No.: 14/468,640

(22) Filed: Aug. 26, 2014

(51) Int. Cl.
*F41A 21/00* (2006.01)
*F41A 21/48* (2006.01)
*F41A 21/18* (2006.01)

(52) U.S. Cl.
CPC ..... *F41A 21/484* (2013.01); *F41A 21/18* (2013.01)
USPC ..... 42/78; 42/76.01

(58) Field of Classification Search
CPC ..... F41A 21/48; F41A 9/23; F41C 27/00
USPC ..... 42/78, 75.02, 75.04, 75.01
See application file for complete search history.

(56) References Cited

U.S. PATENT DOCUMENTS

| | | | | |
|---|---|---|---|---|
| 255,523 | A | 3/1882 | Ligthtburne, Jr. | |
| 745,464 | A | 12/1903 | Tasker | |
| 757,790 | A | 4/1904 | Tasker | |
| 855,439 | A * | 6/1907 | Adrianson | 42/59 |
| 5,155,291 | A | 10/1992 | Dabrowski | |
| 5,937,563 | A | 8/1999 | Schuetz et al. | |
| 6,273,080 | B1 * | 8/2001 | Sullivan, Jr. | 124/84 |
| 6,357,331 | B1 | 3/2002 | Dionne | |
| 6,655,372 | B1 * | 12/2003 | Field et al. | 124/83 |
| 7,076,904 | B1 | 7/2006 | Rustick | |
| 8,087,194 | B1 | 1/2012 | Vuksanovich | |
| 8,240,074 | B2 | 8/2012 | Vuksanovich | |
| 8,539,708 | B2 | 9/2013 | Kenney et al. | |
| 2012/0131834 | A1 | 5/2012 | Barrett et al. | |
| 2014/0075818 | A1 | 3/2014 | Piontek | |

* cited by examiner

*Primary Examiner* — Troy Chambers
*Assistant Examiner* — Bridget Cochran
(74) *Attorney, Agent, or Firm* — Louis Ventre, Jr.

(57) ABSTRACT

A system for firearm barrel modification includes a firearm, a collar and an auxiliary barrel. The firearm has a barrel with holes extending inward from the first muzzle end. The barrel has rifling. The collar surrounds the barrel to serve as a securing anchor for an auxiliary barrel. A sleeve slidably engages onto the firearm from the muzzle. The sleeve contains a tubular component, serving as a barrel extension. The tubular component extends from within the sleeve to form a second muzzle at the opposite end. The mating end of the barrel extension is situated within the sleeve. It butts up against the muzzle and is aligned with the rifling of the gun. Alignment rods protrude from the mating end of the tubular component and insert into corresponding holes at the muzzle end of the firearm. A spring member attached to the sleeve sets in place over the collar.

2 Claims, 3 Drawing Sheets

FIREARM BARREL-MODIFICATION SYSTEM

TECHNICAL FIELD

In the field of firearms, an auxiliary barrel system enables the addition and removal of an auxiliary barrel, such that when added, the rifling on the auxiliary barrel mates up the rifling from the gun.

BACKGROUND ART

Over the years, firearms technology has progressed in many different aspects, but technology of the barrel seems to have lagged behind. Ever since rifling was invented years ago to spin the bullet and increase ballistics performance, the length of various gun barrels has been a very important factor.

Many different situations call for different barrel lengths at different times, and these situations can immediately change the ideal barrel length. Many times a very short barrel of only an inch or two is needed for concealed carry and short range shots.

At other times a standard length pistol barrel is needed for both ease of movement and a reasonable degree of ballistics for medium range shorts. Sometimes a standard length rifle barrel is needed and sometimes a shorter length carbine barrel is the appropriate choice.

For longer distance shots, a very long sniper-type barrel is needed to provide maximum ballistic performance.

A barrel is typically secured to a receiver on a firearm with an annular collar extending downward from the barrel to define a face that can be secured to a receiver with a barrel nut in a screwed connection held by the receiver. A screwed connection is not what is used or described herein.

Barrel extensions are known for converting a larger caliber weapon to a sub-caliber weapon. In order to fire a different caliber in a firearm than what the firearm was initially designed to accommodate, a caliber conversion kit creates a smaller bore. A caliber conversion kit changes the caliber of ammunition a firearm fires, usually from a larger caliber to a smaller caliber so that one can fire less expensive ammunition. Such conversion kits typically use a threaded connection for a supplemental barrel and are not known for an auxiliary barrel of the same caliber as the weapon.

SUMMARY OF INVENTION

A system for firearm barrel modification includes a firearm having a barrel with holes extending inward from the first muzzle end and also having rifling on the barrel wall. A collar surrounds the barrel near the muzzle that serves as a securing anchor for an auxiliary barrel. A sleeve slidably engages onto the firearm from the muzzle. The sleeve contains a tubular component, serving as a barrel extension. The tubular component extends from within the sleeve to form a second muzzle at the opposite end.

The bore of the gun barrel and the bore of the auxiliary barrel have the same diameter. Thus, a mating end of the tubular component within the sleeve butts up to and mates with the muzzle of the gun when the auxiliary barrel is added to the gun. Alignment rods protrude from the mating end of the tubular component. These alignment rods insert into corresponding holes at the muzzle end of the firearm barrel and assure that the lands and grooves of the rifling of the gun barrel align with the lands and grooves of the auxiliary barrel.

A spring member attached to the sleeve sets in place over the collar when the sleeve slidably engages onto the firearm and the mating end abuts to the first muzzle, the spring member when so set in place over the collar holds the auxiliary barrel to the firearm.

To enable daisy chaining together auxiliary barrels, a second collar surrounding the tubular component near its muzzle is included so that a spring member on a second auxiliary barrel will set in place over this second collar. The muzzle of the auxiliary barrel also has holes just like the muzzle of the gun, which receives alignment rods on the second auxiliary barrel.

Technical Problem

In military, law enforcement and sporting use, the situation on the ground can rapidly change the most appropriate barrel length choice for a weapon. This creates a practical problem because only so many guns can be carried and each additional weapon adds weight and storage requirements.

Simply adding a barrel that is mismatched with the existing rifling on a weapon is likely to adversely influence the ballistic performance of the shot and thus is not an obvious answer. When the rifling is not aligned, it produces bullet wobble and adversely affects accuracy of the shot. Presently, a shooter has little choice but to travel with a variety of weapons in order to permit selection of the correct properly rifled barrel to accomplish what may be a shifting task.

Solution to Problem

The solution is a dependable technology that enables a shooter to rapidly add or subtract barrel length to a weapon and, when adding barrel length, to do so in a way that the added barrel properly aligns every time with the rifling in the barrel of his weapon. This technological option would go a long way toward protecting our bravest and finest military and law enforcement personnel by giving them the means in the field to choose the exact barrel length they need to stay safe and accomplish their mission.

The existing gun barrel and one or more auxiliary barrels work by having an outer sleeve fixed over a supplemental barrel with a matching bore and similarly cut rifling. The sleeve slides over the original barrel, preferably in a snug fit, and pins extending from the auxiliary barrel within the sleeve are inserted in holes in the original barrel. The supplemental barrel is mechanically held to the original barrel with a spring clamp on the sleeve that engages a collar on the original barrel for a tight abutment of the barrels within the sleeve. A tight abutment of the barrels within the sleeve contains explosive gas pressures when a bullet is shot.

Advantageous Effects of Invention

Enabling rifling alignment when extending the barrel length of a firearm offers the shooter an option to address a variety of shooting needs using a single weapon. The firearm barrel-modification system delivers a capability to instantly change a gun to the required barrel length to meet the needs of a soldier, law enforcement officer or hunter.

A gun's barrel can be lengthened by adding on a specific length auxiliary barrel using a system that automatically and properly aligns the rifling along the full length of the original barrel plus the auxiliary barrel. The rifling ridges and grooves on the existing barrel are aligned with the ridges and grooves on the auxiliary barrel by a pin alignment arrangement, which unerringly lines up those ridges and grooves. Rifling alignment avoids problems with bullet wobble and inaccuracy of the firearm stemming from misaligned rifling.

The system that enables rifling alignment in added barrels applies when daisy chaining or adding two or more auxiliary barrels to the weapon.

Within a matter of seconds, a law enforcement officer or soldier can instantly change his pistol into either carbine or a long-range sniper weapon. The spring member enables securing the auxiliary barrel (215) to the firearm (205) without a threaded connection of any kind and is a fast and simple slide on connection. Rifling track alignment provides our soldiers with a whole new line of firearm options to help them accomplish their mission and return home safe.

BRIEF DESCRIPTION OF DRAWINGS

The drawings illustrate preferred embodiments of the firearm barrel-modification system according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
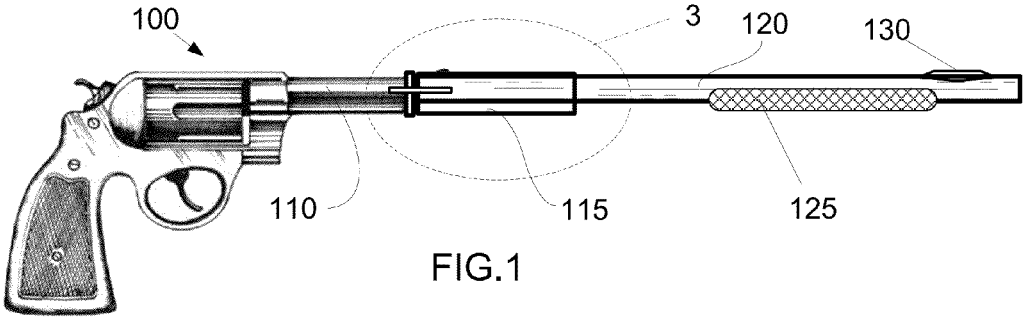
FIG. 1 is a side elevation view of a revolver with an auxiliary barrel.
Figure 2:
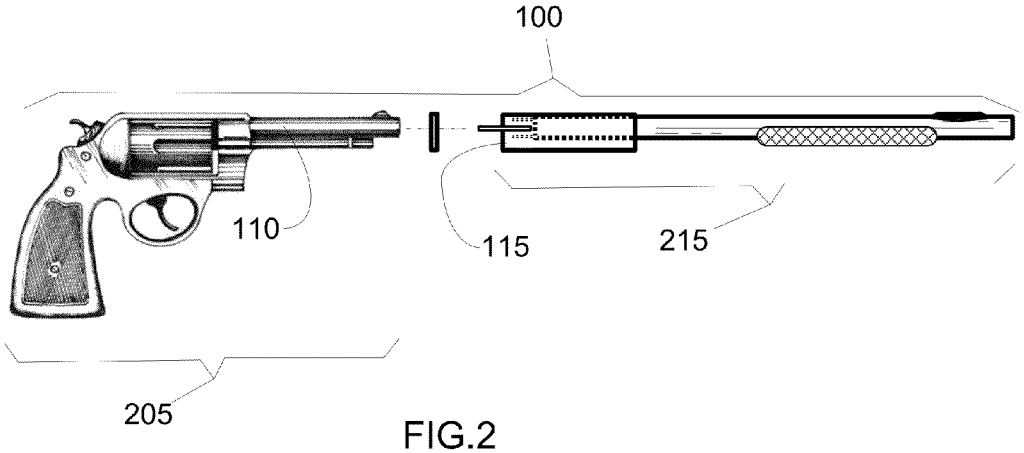
FIG. 2 is an exploded side elevation view of a revolver and auxiliary barrel of FIG. 1.

FIG. 1 and FIG. 2 show a side elevation view of an embodiment of the system (100) for firearm barrel modification. The system (100) includes a firearm (205), a collar (625) surrounding the barrel (110) of the firearm (205); and an auxiliary barrel (215).

While the embodiment shown in FIG. 1 and FIG. 2 includes the firearm (205) that is a revolver, the revolver is intended to be representative of a gun with a barrel. The firearm (205) may be any type of portable barreled weapon. For example, other common types of firearm (205) include a semiautomatic pistol, a rifle and a shotgun.

Figure 5:
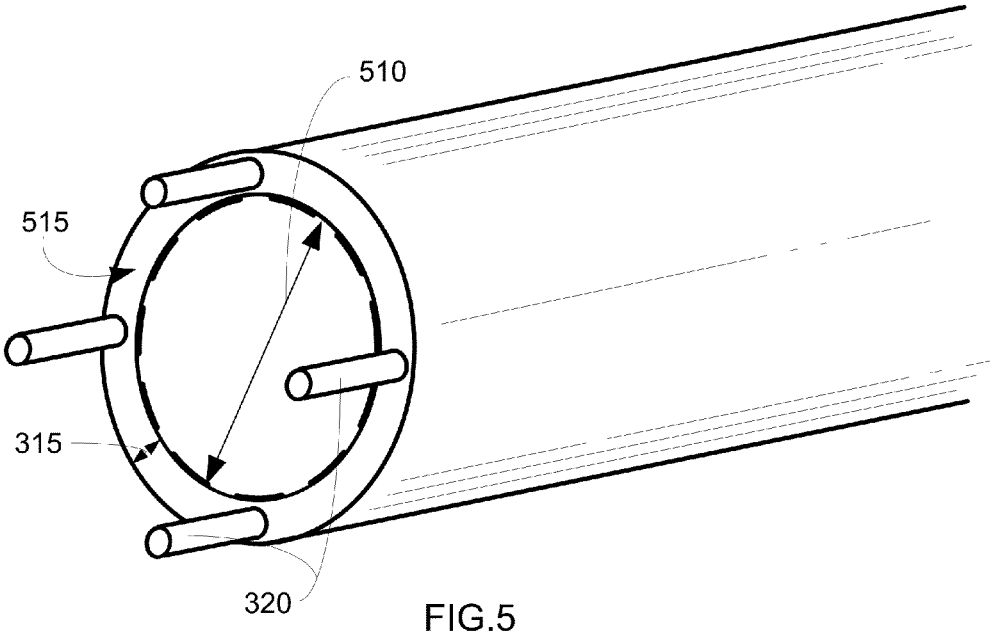
FIG. 5 is a side elevation view of the tubular component of the auxiliary barrel.
Figure 6:
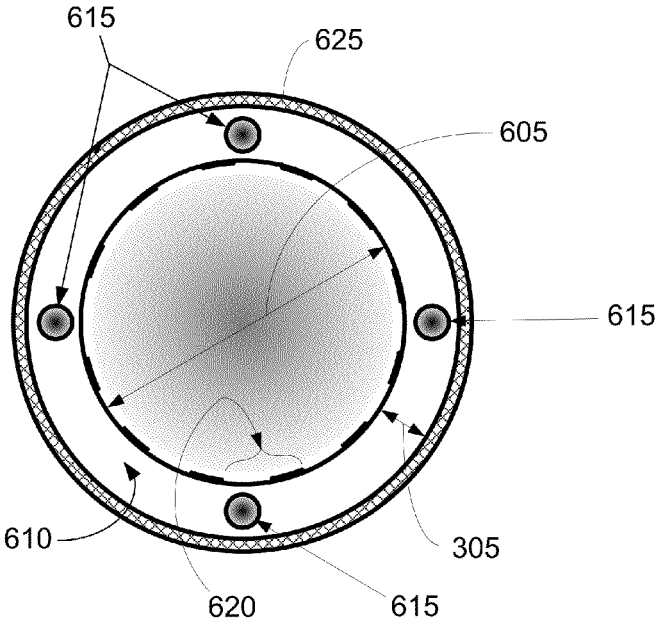
FIG. 6 is an end elevation view of the barrel on a firearm showing apertures that receive the alignment rods, the collar around the barrel and rifling within the bore.

The barrel (110) of the firearm (205) is a tubular member that defines the bore of the gun, which is termed first bore (605), identified in FIG. 6, to distinguish it from the bore of the auxiliary barrel (215), which is referred to herein as the second bore (510), identified in FIG. 5.

Figure 3:
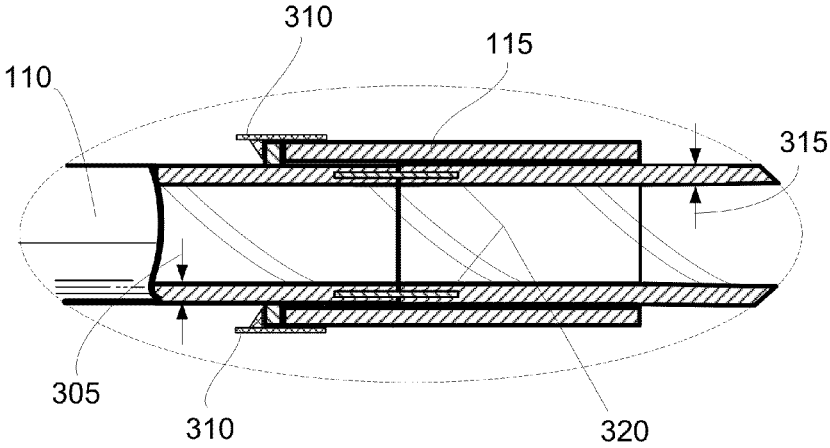
FIG. 3 is a portion of a view identified in FIG. 1 and enlarged for magnification purposes showing the connection of the revolver and auxiliary barrel.

The first bore (605) of the barrel (110) is enclosed by a first wall (305), identified in FIG. 3, of the barrel (110). Thus, the barrel defines the first wall (305), which in turn defines a first bore (605).

The barrel (110) of the firearm (205) also defines a first muzzle (610), which is the end of the barrel (110) where a bullet exits or is discharged upon firing a cartridge.

In the system (100), the barrel (110) of the firearm (205) also defines a plurality of apertures (615) extending from the first muzzle (610) inward into the first wall (305). Each of the apertures in the plurality of apertures (615) is bored into the barrel (110) wall from the first muzzle (610), preferably parallel to the first bore (605).

The barrel (110) of the firearm (205) includes rifling, termed first rifling (620) to distinguish over the second rifling (410) of the auxiliary barrel (215). Rifling refers to helical grooves etched into the inner wall of the barrel that interface with the bullet and force it to rotate as it rapidly transits the bore. The helical grooves are typically described by a twist rate, which indicates the distance the rifling takes to complete one full revolution, such as 1 turn in 8 inches. Rifling is often described in terms of grooves, which are the spaces that are cut out of the barrel wall, and the resulting ridges, which are called lands. Bullet spin serves to gyroscopically stabilize the bullet, improving its aerodynamic stability and accuracy. Thus, the barrel (110) of the firearm (205) defines first rifling (620) on the first wall (305).

The system (100) includes a collar (625) surrounding the barrel (110). In its simplest embodiment, the collar (625) is a clamp that is removably tightenable around the barrel. In preferred embodiments, the collar (625) preferably tightly encircles the barrel and the frame of the gun. The level of tightness is such that, upon firing a bullet, the collar (625) does not move or shift with respect to its position on the firearm (205) when a cartridge is fired from the firearm (205) in the system (100).

The auxiliary barrel (215) includes a sleeve (115); a tubular component (120); a plurality of alignment rods (320); and a spring member (310).

The sleeve (115) is the component that slidably engages onto the firearm (205) from the first muzzle (610). The sleeve (115) may be configured with a cut-out for the sight on the barrel (110) or may be configured to accommodate other structural features of the firearm (205).

The tubular component (120) extends from a fixed position within the sleeve (115). Essentially, the sleeve (115) covers and extends past one end of the tubular component (120).

The tubular component (120) is essentially the barrel portion of the auxiliary barrel (215). Thus, the tubular component (120) has a second wall (315) defining a second bore (510) equal in size to the first bore (605).

The auxiliary barrel (215) is intended to be an extension of the barrel (110) of the firearm (205). A mating end (515) of the tubular component (120) butts up against the first muzzle (610) with the first rifling (620) aligned with the second rifling (410) so that a fired bullet sees a minimum of path and rotation disruption in the transition from the barrel (110) of the gun to the tubular component (120). When the rifling is not aligned, bullet wobble and inaccuracy of the firearm can result. The mating end (515) thus abuts to the first muzzle (610).

Figure 4:
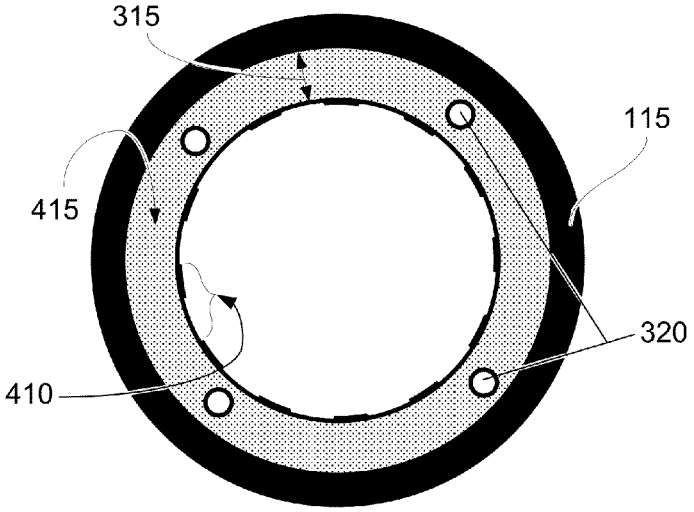
FIG. 4 is an end elevation view of the auxiliary barrel showing alignment rods within the sleeve and rifling.

The auxiliary barrel (215) has a second muzzle (415), identified in FIG. 4, opposite the mating end (515). The second muzzle (415) is where a bullet fired in the firearm (205) exits the auxiliary barrel (215) in the system (100).

The auxiliary barrel (215) has second rifling (410) on the second wall (315). The second rifling (410) mates up with the first rifling (620) when the sleeve (115) slidably engages onto the firearm (205) so that the second bore (510) abuts against the first muzzle (610). This mating up of the first rifling (620) with the second rifling (410) means that a bullet fired from the firearm (205), is controlled by more or less continuous rifling so that the forced rotation and axial velocity of the bullet is minimally affected by the transition from the barrel (110) to the auxiliary barrel (215).

The auxiliary barrel (215) includes a plurality of alignment rods (320) protruding from the mating end (515) of the auxiliary barrel (215). Each of the alignment rods in the plurality of alignment rods (320) extends from and is confined within the wall thickness of the tubular component (120).

Each alignment rod in the plurality of alignment rods (320) is insertable into a corresponding aperture in the plurality of apertures (615) extending from the first muzzle (610). Thus, each aperture in the plurality of apertures (615), that is each hole extending from the first muzzle (610) into the wall thickness of the barrel (110), is of a diameter and axial length sufficient to receive an alignment rod in the plurality of alignment rods (320), preferably in a snug fit so that the first muzzle (610) is abutted up against the mating end (515) of the auxiliary barrel (215).

The alignment rods assure that when so abutted, the first rifling (620) mates up with the second rifling (410) in as an exact an alignment as may be practical. Thus, the grooves and the lands of the rifling in the barrel (110) and the tubular component are in alignment when the auxiliary barrel (215) is connected in the system (100).

The auxiliary barrel (215) includes a spring member (310) attached to the sleeve (115). The spring member (310) bends up and over the collar (625) as the sleeve is slid over the barrel (110). The spring member (310) enables securing the auxiliary barrel (215) to the firearm (205) without a threaded connection of any kind.

Figure 8:
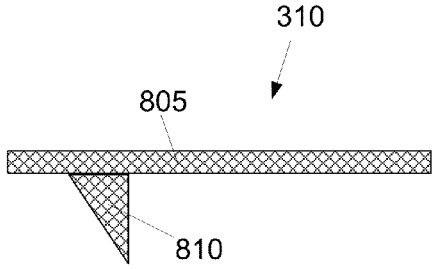
FIG. 8 is a side elevation view of a spring member.
Figure 7:
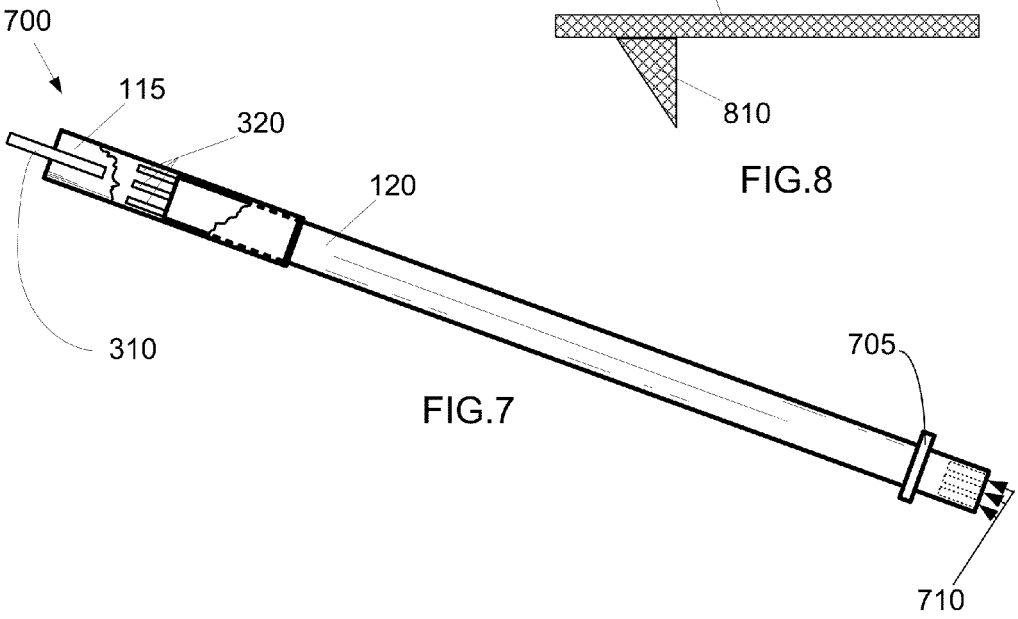
FIG. 7 is a second auxiliary barrel with a second collar and apertures enabling daisy chaining auxiliary barrels.

The spring member (310), shown in enlarged detail in FIG. 8, has a flat segment (805) and a triangular lift segment (810). The flat segment (805) is a spring that bends away from the barrel (110) and snaps back once the triangular lift segment (810) passes over the collar (625). The triangular lift segment (810) sets in place over the collar (625) when the sleeve (115) slidably engages onto the firearm (205). When fully set in place, the mating end (515) of the tubular component (120) abuts to the first muzzle (610). The spring member (310) when so set in place over the collar (625) holds the auxiliary barrel (215) to the firearm (205). The spring member (310) is released by pulling it up and away from the collar (625). When so released, the auxiliary barrel (215) can be slid off the barrel (110) and disengaged from the firearm (205).

The collar (625) is in part what is used in combination with a spring member (310) to axially hold the auxiliary barrel (215) to the barrel (110) of the gun so that the auxiliary barrel (215) cannot unintentionally disengage from the firearm (205) during firing. Once the spring member (310) engages the collar (625), this arrangement effectively precludes axial movement of the auxiliary barrel (215) as a result of the pressure from the discharge of a cartridge.

The system (100) is optionally configurable to daisy chaining of auxiliary barrels. In this optional alternative embodiment, a second auxiliary barrel (700) is added to the second muzzle (415) in much the same way as the auxiliary barrel (215) is added to the firearm (205).

In order for this optional configuration to be operable, the auxiliary barrel (215) also includes a second collar (705) surrounding the tubular component (120) near the second muzzle (415). The second collar (705) is positioned on the tubular component (120) so that a spring member (310) on the second auxiliary barrel (700) will set in place over the second collar (705). Thus, this second collar (705) serves the same purpose as the collar (625) on the firearm (205), as discussed above.

In addition, for this optional configuration, the second muzzle (415) defines a plurality of second apertures (710) extending from the second muzzle (415) inward into the second wall (315). Again these second apertures (710) serve the same purpose as the plurality of apertures (615) in the barrel (110) of the firearm (205).

In alternative embodiments, optional features may be added to the auxiliary barrel (215). Accordingly, and as non-limiting examples, a foregrip (125) may be added to the auxiliary barrel (215) to facilitate aiming the firearm (205) when the auxiliary barrel (215) is attached. The foregrip (125) shown is illustrative and any attachment facilitating a hand hold may be added. Also, the auxiliary barrel (215) may further include an auxiliary sight (130) to assist in aiming.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A system for firearm barrel modification comprising:
a firearm comprising:
a barrel, the barrel comprising a first wall defining a first bore; and
a first muzzle;
the barrel defining:
a plurality of apertures extending from the first muzzle inward into the first wall; and
first rifling on the first wall;
a collar surrounding the barrel; and
an auxiliary barrel comprising:
a sleeve that slidably engages onto the firearm from the first muzzle;
a tubular component that extends from a fixed position within the sleeve, the tubular component comprising:
a second wall defining:
a second bore equal in size to the first bore;
a mating end that abuts to the first muzzle;
a second muzzle opposite the mating end; and
second rifling on the second wall, the second rifling mating up with the first rifling when the sleeve slidably engages onto the firearm so that the second bore abuts against the first muzzle;
a plurality of alignment rods protruding from the mating end, wherein each alignment rod in the plurality of alignment rods is insertable into a corresponding aperture in the plurality of apertures extending inward from the first muzzle; and
a spring member attached to the sleeve that sets in place over the collar when the sleeve slidably engages onto the firearm and the mating end abuts to the first muzzle, the spring member when so set in place over the collar holds the auxiliary barrel to the firearm.

2. The system of claim 1, further comprising:
a second collar surrounding the tubular component;
wherein the second muzzle defines a plurality of second apertures extending from the second muzzle inward into the second wall; and wherein the second collar is positioned on the tubular component so that the spring member on a second auxiliary barrel will set in place over the second collar.

* * * * *